United States Patent [19]

Escallier et al.

[11] Patent Number: 4,501,929

[45] Date of Patent: Feb. 26, 1985

[54] MULTICONDUCTOR FLAT CABLE

[75] Inventors: Edward A. Escallier, Norwalk; Stanley R. Dawson, Corona; Joseph M. Shaheen, La Habra, all of Calif.

[73] Assignee: The United States of America as represented by the Secretary of the Air Force, Washington, D.C.

[21] Appl. No.: 586,953

[22] Filed: Mar. 7, 1984

Related U.S. Application Data

[62] Division of Ser. No. 375,640, May 6, 1982.

[51] Int. Cl.[3] ..... H01B 7/08

[52] U.S. Cl. ..... 174/117 F

[58] Field of Search ..... 174/72 TR, 117 F, 117 PC; 361/398

[56] References Cited

U.S. PATENT DOCUMENTS

| | | | |
|---|---|---|---|
| 3,523,844 | 8/1970 | Crimmins et al. | 174/117 F |
| 4,000,558 | 1/1977 | Cahill | 174/72 A X |
| 4,375,379 | 1/1983 | Luetzow | 174/117 F X |
| 4,406,915 | 9/1983 | Lang | 174/117 F |

FOREIGN PATENT DOCUMENTS

| | | | |
|---|---|---|---|
| 386047 | 12/1923 | Fed. Rep. of Germany | 174/72 TR |
| 1211705 | 3/1960 | France | 174/117 F |

*Primary Examiner*—A. T. Grimley
*Assistant Examiner*—Morris H. Nimmo
*Attorney, Agent, or Firm*—Donald J. Singer; John R. Flanagan

[57] ABSTRACT

A multiconductor flat cable incorporates an approximately right angle turn in its conductor runs. The right angle turn is provided by first securing the conductor runs in a desired spacing through a first lamination of insulation cover and base sheets while leaving portions of the conductor runs exposed through a window in the first lamination. The first lamination is then severed at the lateral edges of the window so that an end portion of the first lamination may be moved ninety degrees relative to a remaining body portion thereto. The right angle turn is then secured by forming a second lamination with cover and base layers so as to overlap the first lamination and the turn in the conductor runs.

2 Claims, 12 Drawing Figures

MULTICONDUCTOR FLAT CABLE

RIGHTS OF THE GOVERNMENT

The invention described herein may be manufactured and used by or for the Government of the United States for all governmental purposes without the payment of any royalty.

This is a division of application Ser. No. 375,640 filed May 6, 1982.

BACKGROUND OF THE INVENTION

1. Field of the Invention

The present invention broadly relates to the provision of a multiconductor flat cable and, more particularly, is concerned with the incorporation of an angular turn, preferably of approximately ninety degrees, in the multiple conductor runs of the cable.

2. Description of the Prior Art

A wide variety of configurations of multiconductor flat cable and techniques for manufacturing the same are known in the prior art. The patents to Crimmins et al., U.S. Pat. No. 3,523,844; and Cahill, U.S. Pat. No. 4,000,558, respectively disclose continuous and noncontinuous operations for making multiconductor flat cable.

Crimmins et al. assemble a plurality of conductors between two sheets of insulation material, in a continuous operation, by using a plurality of tubes to guide the plurality of conductors into desired side-by-side spacings. Then, the conductors and sheets of insulation positioned at upper and lower sides of the spaced conductors are together fed into the nip of upper and lower heated rollers for bonding the sheets together.

Cahill assembles a flat wiring harness, in a noncontinuous operation, by placing a lower insulation sheet in a positioning jig located on a platen, individually feeding wires of desired length one at a time and into a desired pattern on the lower sheet, then adding an upper insulation sheet to the platen on top of the wires and compressing it into the place on the lower sheet. The wires are individually applied in the desired pattern by moving the platen, which mounts the lower sheet, along orthogonal X and Y axes in accordance with a predetermined program as the individual wire is fed onto the lower sheet.

While these two cable manufacturing or assembling operations are undoubtedly satisfactory for providing the cable configuration requirement desired in each case, a need exists for a less complicated, simpler way of assembling a flat cable so that an angular turn, such as of approximately ninety degrees, may be incorporated in the multiple conductor runs thereof.

SUMMARY OF THE INVENTION

The present invention provides a multiconductor flat cable structure and assembling method and apparatus designed to satisfy the aforementioned need. The angular turn, such as of approximately ninety degrees, in the multiconductor cable is provided without folding the cable. Instead, the spacing between adjacent ones of the multiple runs or wires of the cable is maintained relatively uniform at a given location along the cable, so that wires at the right side of the detector or narrow end of the cable are the same wires as those at the right side of the connector or broad end of the cable.

In the method and apparatus of the present invention, a mandrel plate with combs mounted at its opposite ends is mounted on a fixture for rotation about a predetermined axis such that the combs will move about the axis with the plate as it is rotated. As the plate is rotated, a continuous strand of conductor is held in alignment with the grooves of the combs so as to wind the conductor about the plate and combs. Insulation cover and base sheets may be applied to the plate with multiple runs of the continuous strand of conductor extending between them. The plate with the cover and base sheets and wrapped conductor thereon is placed in a press where the sheets are bonded together to form a first lamination, holding the multiple runs of conductor in the alignment achieved during the winding process.

For providing an angular turn in the cable, this first lamination is severed into end and body portions at the lateral edges of a pair of aligned windows previously formed in the cover and base sheets prior to their placement on the mandrel. The severed portions are interconnected by exposed portions of the conductor runs. Now, the end portion of the first lamination may be moved within the plane of the body portion so to place the exposed portions of the conductor runs into an angular configuration, such as of ninety degrees, and the end portion is then re-attached to the plate. The conductor runs, or wires, are secured in this angular position by placing a cover and base insulation layer on either side of the exposed wires, overlapping the end and body portions of the first lamination, and by then performing a second bonding operation, which provides a second lamination covering the exposed, right angle-turned wires. These added cover and base layers of insulation provide the necessary mechanical support for the cable's right angle turn or transition area.

DETAILED DESCRIPTION OF THE INVENTION

Figure 1:
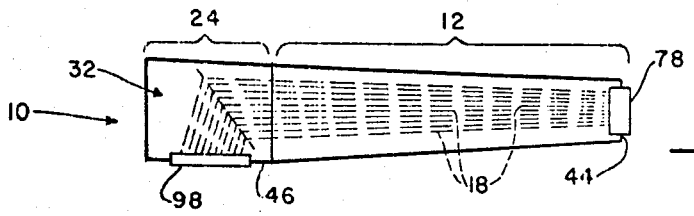
FIG. 1 is a plan view of a multiconductor flat cable of the present invention.

Referring now to the drawings, and more particularly to FIG. 1, there is shown the preferred embodiment of the multiconductor flat cable of the present invention, being generally designated 10.

Figure 2:
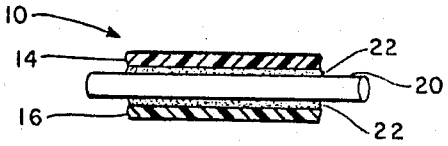
FIG. 2 is a fragmentary enlarged elevational view, in partial cross section, of the first lamination in the multiconductor flat cable of FIG. 1.

A first portion 12 of the cable 10, as seen in greater detail in FIG. 2, is in the form of a first lamination comprised basically by a first insulation cover sheet 14, a first insulation base sheet 16, and separate multiple runs 18 of a conductor 20 located between the first cover and base sheets 14, 16. Additionally, each of the cover and base sheets 14, 16 includes an adhesive coating 22 on a surface thereof which is incorporated into the interior of cable 10.

In an exemplary embodiment, acrylic adhesive coated polyimide film (Kapton) provides the material for adhesive coated insulation cover and base sheets 14, 16. Each sheet is 0.002 inch in thickness, 0.001 inch thick Kapton and 0.001 inch thick acrylic adhesive coating. Maganin wire, 0.002 inch in diameter, provides the conductor 20 for the cable 10.

Figure 3:
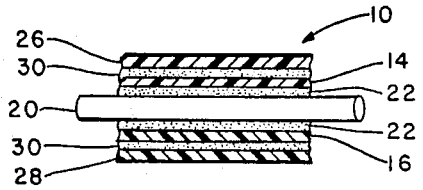
FIG. 3 is a fragmentary enlarged elevational view, in partial cross section, of the first and second laminations in the multiconductor flat cable of FIG. 1.

A second portion 24 of the cable is in the form of a second lamination. In regions of cable portion 24 located adjacent to first cable portion 12, the second lamination is made over the first lamination, as seen in detail in FIG. 3. The second lamination is comprised basically of a second insulation cover layer 26 and a second insulation base layer 28, with each layer having an adhesive coating 30 on its inner surface. The second cover layer 26 is bonded to the outer surface of first cover sheet 14, while second base layer 28 is bonded to the outer surface of first base sheet 16. However, for most of the second cable portion 24, second cover and base layers 26, 28 directly overlie, and contact, portions of the conductor runs 18 and are bonded together by the adhesive coatings 30 on their inner facing surfaces. In an exemplary embodiment, second cover and base layers 26, 28 are identical in material, thickness and adhesive composition to first cover and base sheets 14, 16.

In second portion 24 of cable 10, at an area generally designated 32, the separate conductor runs 18 make an angular turn, preferably of approximately ninety degrees or at a right angle, although other angles are possible. The second lamination, by being formed at this general area of the cable 10 following formation of the turn in the conductor runs 18, as will be explained hereinafter, supports and permanently maintains the angular turn of the conductor runs 18.

Turning now to FIGS. 4 through 12, the procedures followed in assembling flat cable 10 are schematically depicted. Also, in FIGS. 5 and 6, apparatus is illustrated for winding a single strand of conductor 20 onto base sheets 14, 16 to produce the separate conductor runs 18 while supporting these base sheets 14, 16 with a mandrel 34 prior to bonding the sheets together to form the first lamination of the cable 10.

Figure 6:
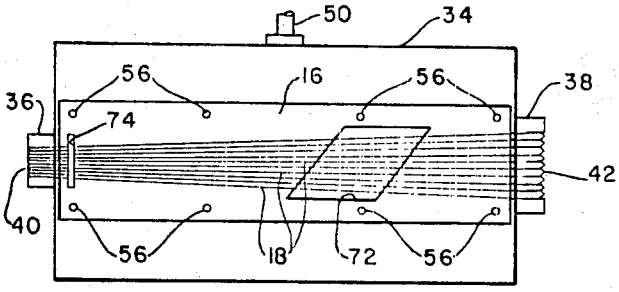
FIG. 6 is a plan view of the mandrel plate and base sheet with the conductor wrapped around the combs on opposite ends of the plate as seen along line 6—6 of FIG. 5.
Figure 5:
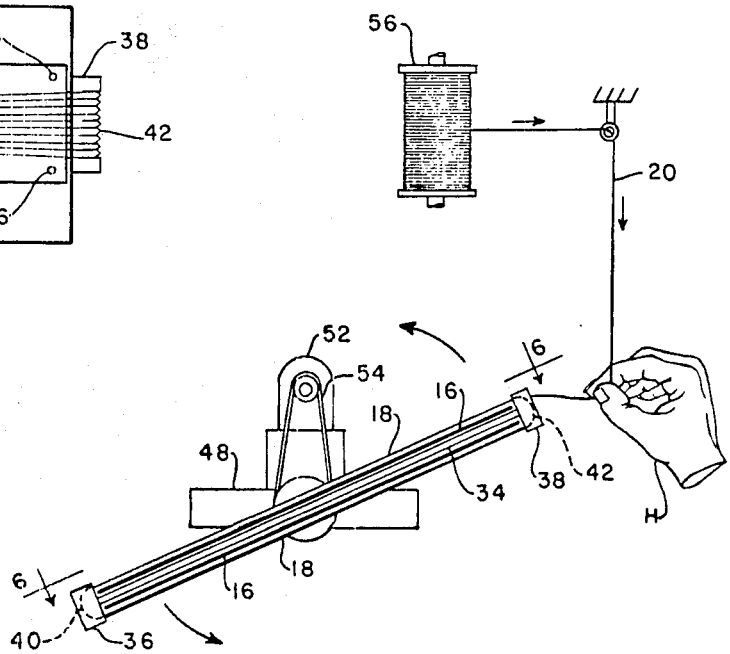
FIG. 5 is a schematic view of apparatus useable for winding a conductor around an insulation base sheet during assembly of a flat multiconductor cable on each face of a mandrel plate.

Considering first the apparatus of the present invention shown in FIGS. 5 and 6, the flat mandrel plate 34, made from any suitable material such as aluminum, is provided with a pair of combs 36, 38 mounted at its opposite ends. Each comb has a thickness greater than that of plate 34 so as to extend both above and below the opposite faces thereof. Comb 36 has a series of V-shaped grooves 40 with a 0.006 inch pitch, while comb 38 has similarly shaped grooves 42 with a 0.025 inch pitch. Pitch is selectable through variance of comb groove spacing and length of the cable. As seen in FIG. 1 with regards to finished cable 10, different groove pitches on the respective combs will provide different spacing between conductor runs 18 at ends 44 and 46 of the cable 10.

Mandrel plate 34 is rotatably mounted on a fixture 48 by a shaft 50 which defines the rotational axis of the plate so that combs 36, 38 on opposite ends of the plate 34 revolve about shaft 50 as the plate is rotated. Drive means 52, which may take the form of an electric motor, are mounted on the fixture 48 and coupled to shaft 50 by means such as belt 54, for rotating the mandrel plate while a strand of conductor 20 from a suitable source of supply, such as spool 56, is held in alignment with the grooves of combs 34, 36 so as to wind the conductor about the plate and combs. Plate 34 includes means for attaching insulation base and cover sheets 14, 16 on its opposite faces. The attaching means are schematically indicated as 56 in FIG. 6. Attaching means 56 may take the form of conventional fasteners, such as screws, clips or other devices to hold sheets 14, 16 to mandrel 34.

Figure 4:
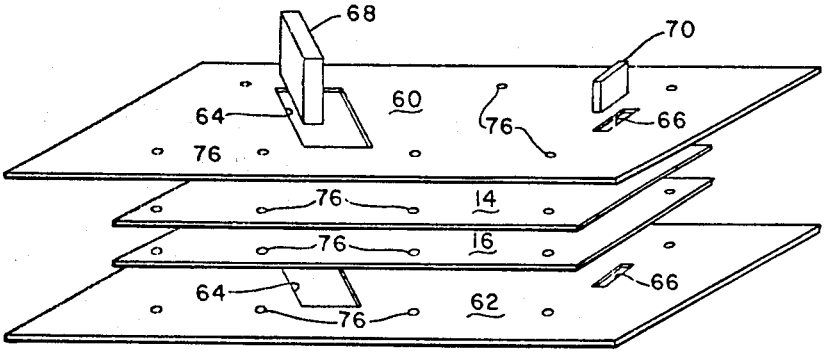
FIG. 4 is a schematic view of the insulation cover and base sheets with cutout templates and punches designed to produce windows in the insulation sheets.

Considering now the method of the present invention for assembly of multiconductor flat cable 10, FIG. 4 schematically shows, in exploded form, a pair of upper and lower templates 60, 62 between which pairs of insulation cover and base sheets 14, 16 are placed for cutting out windows, or openings, in the sheets. A properly configured opening 64 is formed in each of the templates as well as a smaller opening 66 near one end. Punches 68, 70 are aligned above openings 64, 66 in upper template 60 and are cross-sectionally sized to fit therethrough to cut windows 72, 74 in the sheets 14, 16. Sheets 14, 16 are clamped between templates 60, 62 by suitable fasteners (not shown) inserted through holes 76 formed in both the sheets and templates. Windows 72 are used for formation of an angular turn in the conductor runs 18 as will be explained in more detail later. Windows 74 provide access to exposed or bare portions of conductor runs 18 for connection to an electrical connector 78 (FIG. 1) at end 44 of the cable 10. Alternatively, windows may be formed in only one of the cover or base sheets, limiting access to exposed conductor runs to only one side of cable 10.

Once windows 72, 74 have been formed in the insulation sheets, as depicted in FIGS. 5 and 6, the base sheets 14 are applied to opposite faces of mandrel plate 34 and fastened to it by screws 56 or the like. A continuous strand of conductor 20 is then wound about mandrel plate 34 and combs 36, 38, over base sheets 16 on both faces of the plate.

Figure 7:
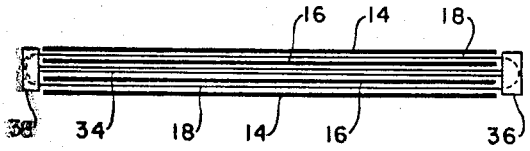
FIG. 7 is an elevational view of the mandrel plate with an insulation cover sheet applied to the base sheet on each face of the plate.

Once conductor 20 has been fully wound on mandrel 34, as shown in FIG. 6, insulation cover sheets 14 are applied to opposite faces of the plate and attached thereto by means 56 so as to overlie base sheets 16 and conductor runs 18 extending therebetween. This condition of the cables, prior to bonding the sheets 14, 16 together, is illustrated in FIG. 7. Dimensions in FIGS. 7, 8, 11 and 12 are exaggerated for purposes of illustrating parts of assembled cable 10.

Figure 8:
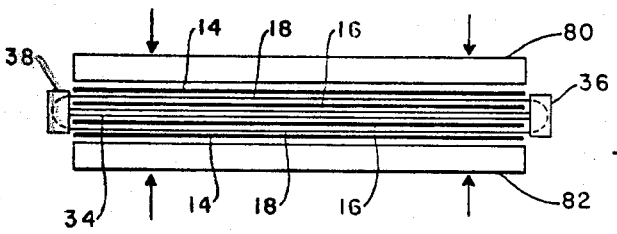
FIG. 8 is an elevational view similar to that of FIG. 7, but, in addition, showing the mandrel plate and cable assemblies on the opposite faces thereof positioned between platens of a bonding press for forming a first lamination in each cable.

Mandrel plate 34 with assembled cables attached thereto is then placed in a hydraulic press, as schematically depicted in FIG. 8, where formation of the first lamination in each cable takes place. Press platen members 80, 82 are brought to bear against insulation cover sheets 14 on opposite faces of mandrel plate 34, with slip sheets (not shown) being present between members 80, 82 and cover sheets 14, for applying heat and pressure to the cable assemblies, thereby bonding cover and base sheets together.

By way of example, platens 80, 82 are preheated to 350° F. Bonding base and cover sheets 14, 16 of the cables together occurs while platens are held together at 300 psi for 1.5 hours. Platens 80, 82 are then cooled to 150° F. maintaining 300 psi on the cable base and cover sheets 14, 16, and, thereafter, finished cables 10 may be removed from the press.

Figure 9:
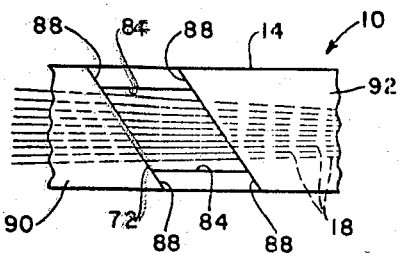
FIG. 9 is a fragmentary plan view of the first lamination of the cable, showing it severed at opposite edges of a window formed therein in preparation for producing an approximately right angle turn in the multiple conductor runs of the cable.

The next step in the fabrication is formation of the desired angular turn in the conductor runs 18 of cable 10. As was mentioned earlier, windows 72 in the insulation base and cover sheets 14, 16 are used to facilitate formation of the desired angular turn in the cable at area 32, as seen in FIG. 1. In FIG. 9, conductor runs 18 are exposed between the opposite edges 84 of windows 72.

Figure 12:
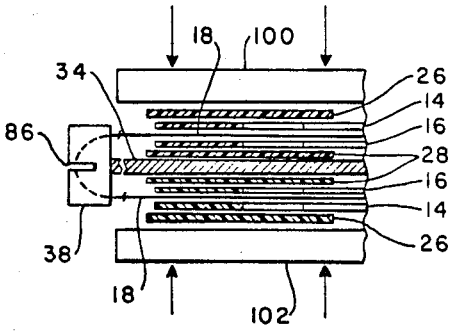
FIG. 12 is a fragmentary elevational view, in partial cross section, similar to that of FIG. 11, but, in addition, showing the mandrel plate and cable assemblies of the opposite faces thereof, as seen along line 12—12 of FIG. 10, positioned between platens of a bonding press for forming a second lamination in each cable.

To prepare the cable for making the desired angular turn, such as a right angle turn, the conductor runs 18, extending around the comb 38, are first severed by insertion of a cutting tool through transverse slot 86 of comb 38, as in FIG. 12, and the base and cover sheets of the first lamination are severed at cut lines 88 running through opposite lateral edges of windows 72. Conductor runs 18 are exposed, but not cut, in this operation. The first lamination is thus cut into an end portion 90 and a body portion 92, which portions are interconnected by the exposed portions of conductor runs 18. Cable 10 remains attached to mandrel plate 34 as seen in FIG. 10 at its body portion 92.

Figure 10:
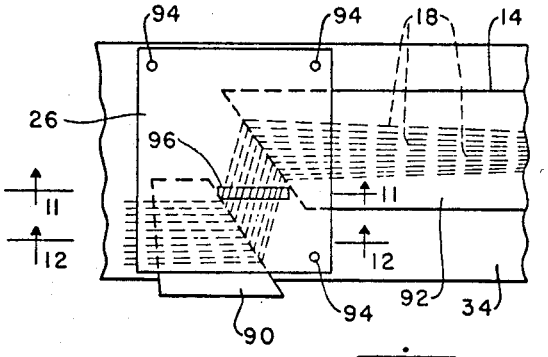
FIG. 10 is a fragmentary plan view of the cable just after the right angle turn has been completed and insulation cover and base layers have been applied to the turn transition area of the cable.

End portion 90 of cable 10 may now be moved manually in its plane relative to stationary body portion 92 to the position shown in FIG. 10 so as to form the desired angular turn, such as ninety degrees, in the multiple runs 18 of the conductor 20. It will be observed that the right angle turn has now been provided without the necessity of folding the cable at a right angle.

Figure 11:
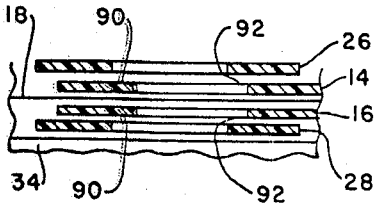
FIG. 11 is a fragmentary elevational view, in cross section, of the insulation cover and base layers applied to the first lamination of the cable on one face of the mandrel plate as seen along line 11—11 of FIG. 10.

The conductor runs 18 are then secured at the desired angle, such as the right angle turn, by applying second insulation cover and base layers 26, 28 to opposite sides of the severed end and body portions 90, 92 of the first lamination so as to overlap these portions and cover the turn of the conductor runs 18, as seen in FIGS. 10 and 11. Cover and base layers 26, 28 are attached to mandrel plate 34 by suitable means such as screws 94 or the like, of FIG. 10. Prior to placement of cover and base layers 26, 28 in the cable at area 32, a window 96 is cut in each layer by templates and a punch (not shown) similar to templates 60, 62 and punches 68, 70 described earlier. Window 96 serves to provide access to exposed portions of the conductor runs 18 for addition of a second electrical connector 98 to end 46 of cable 10.

Mandrel plate 34, with the assembled cables mounted thereon, is then placed in the hydraulic press, as in FIG. 12, where a second lamination of the cables takes place. Press platen members 100, 102 are brought to bear against insulation cover layers 26 on opposite faces of mandrel plate 34, with slip sheets (not shown) present between the members and cover layers. Heat and pressure are applied to the cable assemblies in the same sequence as described earlier in the case of the first lamination, forming the second lamination of the cover and base layers 26, 28 together and to the cover and base sheets 14, 16 of the first lamination at areas of overlap. Operating temperature, pressure and time periods of the second lamination are substantially identical to those described earlier for the first lamination.

After finished cable 10 is removed from the press, excess portions of the first and second laminations may be trimmed to provide the configuration seen in FIG. 1. Conductor runs 18 are then severed at ends 44 and 46 of the cable. Additional conventional cleaning and plating operations are performed on exposed portions of the conductor runs 18 at windows 66, 96, which need not be described herein. Electrical connectors 78, 98 are then joined to conductor runs 18 at cable ends 44 and 46 respectively.

The present invention, and its attendant advantages, are apparent from the foregoing description but it is also apparent that changes may be made in the form, construction and arrangement of parts thereof without departing from the spirit and scope of the invention. The embodiment hereinbefore described is merely a preferred or exemplary one, and other types and variations are comprehended by this disclosure.

Having thus described the invention, what is claimed is:

1. A multiconductor flat cable, comprising:

(a) an insulation cover sheet;

(b) an insulation base sheet;

(c) multiple runs of a conductor located between said cover and base sheets;

(d) said cover and base sheets being bonded together so as to form a first lamination;

(e) said cover and base sheets of said first lamination being severed into an end portion and a body portion interconnected by exposed portions of said multiple conductor runs;

(f) said end portion of said first lamination being angularly displaced through a predetermined angle relative to, and within the plane of, its body portion so as to form a corresponding angular turn in said exposed portions of said multiple conductor runs;

(g) an insulation cover layer;

(h) an insulation base layer;

(i) said first lamination being located between said cover and base layers such that said cover and base layers overlap said end and body portions of said first lamination and cover said angular turn in said multiple conductor runs; and (j) said cover and base layers being bonded together and to said cover and base sheets of said end and body portions of said first lamination so as to form a second lamination which permanently maintains said angular turn in said multiple conductor runs.

2. The multiconductor flat cable as recited in claim 1, wherein said angular turn in said exposed portions of said multiple conductor runs is approximately ninety degrees.

* * * * *